US011313082B2

(12) United States Patent
Thitiwutthisakul et al.

(10) Patent No.: US 11,313,082 B2
(45) Date of Patent: Apr. 26, 2022

(54) SHEET MATERIAL COMPRISING FIBER AND NANO-MICROSCALE ORGANIC FIBRILLATED FILLER AND METHOD OF PRODUCING SAID SHEET MATERIAL

(71) Applicant: SCG Packaging Public Company Limited, Bangkok (TH)

(72) Inventors: Kasinee Thitiwutthisakul, Ratchaburi (TH); Prakan Leerapongnun, Amphoe Nonthaburi (TH); Saowanee Arpawasin, Suphanburi (TH); Suebthip Pongpaiboon, Nonthaburi (TH); Chairat Pongtongcharoen, Chachengsao (TH)

(73) Assignee: SCG PACKAGING PUBLIC COMPANY LIMITED, Bangkok (TH)

( * ) Notice: Subject to any disclaimer, the term of this patent is extended or adjusted under 35 U.S.C. 154(b) by 101 days.

(21) Appl. No.: 16/488,710

(22) PCT Filed: Apr. 19, 2017

(86) PCT No.: PCT/TH2017/000033

§ 371 (c)(1),
(2) Date: Aug. 26, 2019

(87) PCT Pub. No.: WO2018/124977

PCT Pub. Date: Jul. 5, 2018

(65) Prior Publication Data

US 2020/0040531 A1 Feb. 6, 2020

(30) Foreign Application Priority Data

Dec. 27, 2016 (TH) ..... 1601007779

(51) Int. Cl.
*D21H 15/10* (2006.01)
*D21H 11/12* (2006.01)
(Continued)

(52) U.S. Cl.
CPC ..... *D21H 15/10* (2013.01); *D21H 11/12* (2013.01); *D21H 11/14* (2013.01); *D21H 11/18* (2013.01); *D21H 17/28* (2013.01); *D21H 23/04* (2013.01)

(58) Field of Classification Search
CPC ..... D21H 15/10; D21H 11/12; D21H 11/14; D21H 11/18; D21H 17/28; D21H 23/04;
(Continued)

(56) References Cited

U.S. PATENT DOCUMENTS 9,127,405 B2 * 9/2015 Husband ..... D21H 5/1236
2012/0080156 A1 * 4/2012 Laleg ..... D21H 17/25 162/158

FOREIGN PATENT DOCUMENTS

CA 2437616 A1 2/2005
CN 101302734 A 11/2008
(Continued)

*Primary Examiner* — Jacob T Minskey
*Assistant Examiner* — Matthew M Eslami
(74) *Attorney, Agent, or Firm* — Troutman Pepper Hamilton Sanders LLP

(57) ABSTRACT

This invention relates to a sheet material comprising fiber and nano-microscale organic fibrillated filler, wherein the nano-microscale organic fibrillated filler comprises micro-fibrillated cellulose and starch granule in such a way that the microfibrillated cellulose is dispersed with starch granule, and the nano-microscale organic fibrillated filler has starch granule at least 15 wt %. Besides, this invention also relates to a method of producing said sheet material comprising fiber and nano-microscale organic filler, wherein the method comprises the steps of (i) preparing pulp suspension, (ii) preparing nano-microscale organic fibrillated filler, (iii) adding the nano-microscale organic fibrillated filler into the pulp suspension, (iv) forming sheet material by pressing, and (v) drying the sheet material, wherein the preparation step of nano-microscale organic fibrillated filler provides the
(Continued)

(a) (b)

nano-microscale organic fibrillated filler comprising microfibrillated cellulose and starch granule in such a way that the microfibrillated cellulose is dispersed with starch granule.

31 Claims, 11 Drawing Sheets

(51) Int. Cl.

| | |
|---|---|
| ***D21H 11/14*** | (2006.01) |
| ***D21H 11/18*** | (2006.01) |
| ***D21H 17/28*** | (2006.01) |
| ***D21H 23/04*** | (2006.01) |

(58) Field of Classification Search
CPC ..... D21H 17/25; D21H 15/02; D21H 5/1236; D21H 19/38; D21H 19/385; D21B 1/30; D21C 9/00; D21C 9/001; D21C 9/007; D21D 1/20
See application file for complete search history.

(56) References Cited

FOREIGN PATENT DOCUMENTS

| | | | | |
|---|---|---|---|---|
| CN | 102154936 | A | 8/2011 | |
| WO | 2011068457 | A1 | 6/2011 | |
| WO | WO-2011068457 | A1 * | 6/2011 | ..... D21H 17/28 |
| WO | 2014072914 | A1 | 5/2014 | |
| WO | WO-2014072914 | A1 * | 5/2014 | ..... D21H 11/18 |

* cited by examiner (a) (b)

SHEET MATERIAL COMPRISING FIBER AND NANO-MICROSCALE ORGANIC FIBRILLATED FILLER AND METHOD OF PRODUCING SAID SHEET MATERIAL

TECHNICAL FIELD

This invention relates to a sheet material, especially paper, comprising organic fibrillated filler prepared from organic agricultural waste and a method of producing said sheet material.

BACKGROUND OF THE INVENTION

Presently, an enhancement of lightweight materials with high strength has received remarkable attention in various industries including paper and packaging industry. Apart from selecting quality pulp in production, an incorporation of additives or fillers to improve the quality and strength properties of paper appears to be another widespread approach. Such additives or fillers may be derived from natural substances such as cationic modified starch, carboxymethyl cellulose, etc.; or synthetic polymers such as polyacrylamide and its derivatives, etc.

Applying additives or fillers with high strength appears to improve overall strength of paper and other materials, e.g polymer composites. Example of high strength natural fibers includes nanocellulose. Examples of high strength synthetic fibers are glass fibers, carbon fibers, etc. Nanocellulose from wood pulp is recognized as a reinforced material for improving paper's strength. However, an industrial scale preparation of nanocellulose remains complicated and costly due to a liberation step of nanocellulose from wood pulp. For example, the pretreatment of wood pulp with chemical or enzyme is required to produce suitable wood pulp for subsequent mechanical disintegration.

Prior arts, particularly patent documents, disclose additives or fillers comprising nano-microcellulose including the sheet material comprising such additives or fillers are exemplified as follow.

U.S. Pat. No. 9,127,405 B2 discloses a paper filler composition, which is aqueous suspension comprising microfibrillated cellulose and inorganic particulate materials such as calcium carbonate, magnesium carbonate, dolomite, gypsum, kaolin, etc. This composition is prepared by co-grinding process, and used as fillers in the paper and coated paper production.

CA 2437616 A1 discloses a manufacturing of nanocellulose from agro-based fibers and root fibers like hemp, flax, sisal, bagasse, wheat straw, etc. The liberation of nanocellulose is conducted by heating pulp slurry at a temperature of 80-90° C. prior to hydrochloric acid and alkaline treatment to remove other impurities, e.g. hemicellulose and extractives in wood pulp; then immersing in liquid nitrogen for 5-10 minutes before isolation step of nanocellulose by mechanical means. The nanocellulose can be used as reinforced materials in polymer composite, e.g. plastic polymer and bioplastic.

CN 102154936 A discloses a method for preparing additives for wet-end papermaking process from cassava residues by diluting and adjusting pH of cassava residues in a range of 9-11 with sodium hypochlorite, chlorine solution, and hydrogen peroxide at a temperature of 30-60° C. for 15-90 minutes, then drying at a temperature of 80-100° C., and adjusting to neutral with hydrochloric acid. The additive is ground to powder prior to further modification.

CN 101302734 A discloses a method for producing a novel biodegradable material from cassava residue and distillers grains by grinding the feedstock till obtaining fiber length of 0.01-0.08 min; Washing and filtrating with moisture controlled between 75-85%; then mixing with paper pulp in a ratio of 2-5 to 5-8 until the mixture having pulp concentration in a range of 1.2-1.5% for processing into the desired packaging.

SUMMARY OF THE INVENTION

This invention relates to a sheet material, especially paper, comprising organic fibrillated filler prepared from organic agricultural waste, and a method of producing said material sheet.

This invention relates specifically to a sheet material comprising fiber and nano-microscale organic fibrillated filler, wherein the nano-microscale organic fibrillated filler comprises microfibrillated cellulose and starch granule in such a way that the microfibrillated cellulose is dispersed with starch granule, and the nano-microscale organic fibrillated filler has starch granule at least 15 wt %.

This invention also relates specifically to a method of producing said sheet material comprising fiber and nano-microscale organic fibrillated filler, wherein the method comprises the steps of (i) preparing pulp suspension, (ii) preparing nano-microscale organic fibrillated filler, (iii) adding the nano-microscale organic fibrillated filler into pulp suspension, (iv) forming sheet material by pressing, and (v) drying the sheet material, wherein the preparation step of nano-microscale organic fibrillated filler provides microfibrillated cellulose dispersed with starch granule.

The aim of this invention is to provide a sheet material comprising fiber and nano-microscale organic fibrillated filler and a method of producing said sheet material—providing advantageous technical results as follow:

- providing the sheet material with enhanced physical properties and strength, i.e. tensile index, burst index, tear index, stretch, tensile energy absorption (TEA), tensile stiffness index, ring crush testing, corrugating medium testing (CMT), short span compression testing (SCT) index, ply bond, porosity, and folding endurance of sheet material.
- providing the method of producing said sheet material with enhanced physical properties and strength. The method is not complicated, fewer production steps, low cost, and environmentally friendly. This is because the method according to this invention does not require pretreatment of organic feedstock with chemicals or enzymes before subsequent mechanical disintegration.
- providing the above method of producing sheet material with enhanced strength properties and can also effectively facilitate drainage in the wet-end papermaking process, i.e. less drainage time comparable to the production method applying nano-microscale organic cellulose fiber from typical wood pulps.

DETAILED DESCRIPTION

The following will explain the details more clearly about this invention.

According to this invention, "organic filler" refers to fillers prepared from organic feedstock, for example, plants, trees, vegetables, whole grains, any part or residue waste thereof such as leaves, branches, stalks, stems, bark, seed, roots, etc.

According to this invention, "nano-microscale organic fibrillated filler" refers to filler prepared from the organic feedstock as outlined above where the nano-microscale organic fibrillated filler comprises at least two components, i.e. microfibrillated cellulose and starch granule, wherein the size of both components is in nanometer and/or micrometer scale.

According to this invention, "microfibrillated cellulose" refers to nanocellulose or fiber with diameter in nanometer scale. Microfibrillated cellulose also includes microfibril, which is a small plant fibers having diameter in nanometer scale, and also a bulk of microfibrils formed by microfibrils agglomeration and microfibrils connection in micrometer scale where microfibrillated cellulose is derived from fibrillation.

Figure 1:
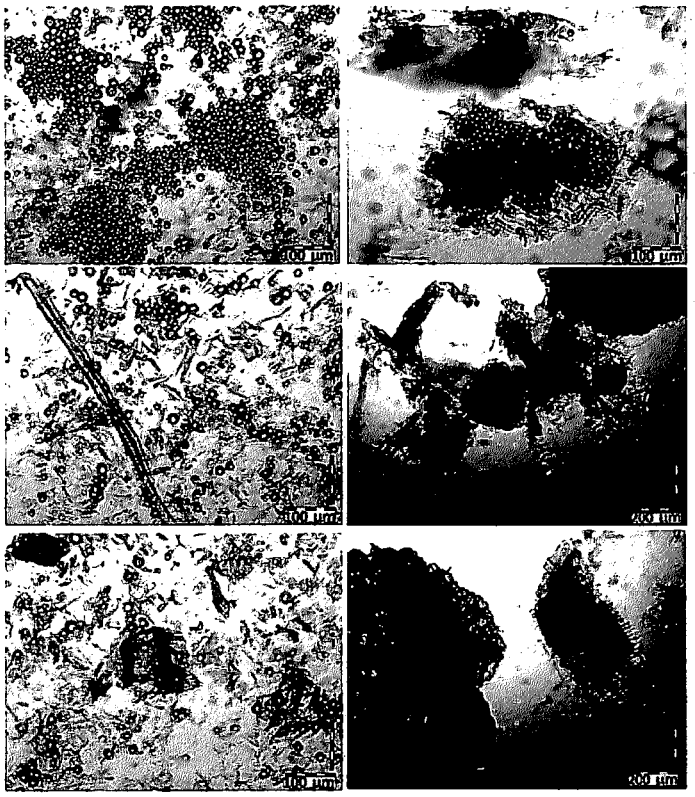
FIG. 1 shows a component of nano-microscale organic fibrillated filler according to this invention (a), and the component of typical organic filler, i.e. the organic feedstock is not passed through a filler preparation step according to this invention (b).

According to this invention, "microfibrillated cellulose dispersed with starch granule" refers to microfibrillated cellulose dispersed and/or distributed uniformly with starch granule particles where the starch granule particles do not agglomerate as a large bulk in the sac. The distribution character of microfibrillated cellulose with starch granule in the nano-microscale organic fibrillated filler according to this invention differs from the nature of fiber and starch granule distribution found in the organic feedstock as shown in FIG. 1.

Sheet Material

The sheet material according to this invention comprises fiber and nano-microscale organic fibrillated filler, wherein the nano-microscale organic fibrillated filler comprises microfibrillated cellulose and starch granule in such a way that the microfibrillated cellulose is dispersed with starch granule, and the nano-microscale organic filler has starch granule at least 15 wt %.

According to this invention, the nano-microscale organic fibrillated filler has a preferred starch granule ranging from 15 wt % to 95 wt %, more preferably from 40 wt % to 90 wt %.

According to this invention, the nano-microscale organic fibrillated filler has microfibrillated cellulose ranging from 5 wt % to 85 wt %, preferably from 10 wt % to 60 wt %.

According to above embodiment, the nano-microscale organic fibrillated filler has microfibrillated cellulose and starch granule as specified above providing the sheet material with enhanced strength and physical properties. Besides, the nano-microscale organic filler also enhances the sheet material formation, for example, paper formation in wet-end papermaking process.

According to this invention, the nano-microscale organic filler has an average particle size ranging from 5 nm to 600 μm, preferably from 50 nm to 200 μm.

According to the above embodiment, the nano-microscale organic filler having the particle size as mentioned above provides a good retention of filler particles in the sheet material, and does not hinder bonding between the fiber in the sheet material providing the sheet material with greater strength.

According to this invention, the nano-microscale organic fibrillated filler is obtained from a method comprising a step of applying shear force at high pressure to organic feedstock.

According to this invention, the applying shear force at high pressure to organic feedstock is performed by using High pressure homogenization where the used pressure is in a range from 100 bars to 10,000 bars, preferably from 200 bars to 2,000 bars.

According to the above embodiment, the nano-microscale organic fibrillated filler derived from isolating microfibrillated cellulose by applying shear force at high pressure leads to better reinforcing property of the sheet material. This is because the starch granule particles are not destroyed or transformed through the filler preparation step according to the invention.

According to this invention, the nano-microscale organic fibrillated filler comprises microfibrillated cellulose with an average diameter, ranging from 5 nm to 100 μm, preferably 50 nm to 10 μm, and an average length ranging from 0.02 mm to 0.5 mm.

According to this invention, the nano-microscale organic fibrillated filler further comprises starch granule having an average particle size ranging from 5 μm to 60 μm.

According to this invention, the nano-microscale organic fibrillated filler can be prepared from agricultural waste having component of cellulose fiber and starch granule. Preferably, the nano-microscale organic fibrillated filler can be prepared from agricultural waste having component of cellulose fiber and fiber sac having starch granule inside of it. The agricultural waste with fiber sac having starch granule inside has starch granule at least 15 wt %, preferably 40 wt % to 90 w %.

According to this invention, the nano-microscale organic fibrillated filler can be prepared from organic feedstock, which is an agricultural waste selected from cassava, potato, sweet potato, sago, taro, yam or a combination of at least two thereof.

According to the above embodiment, the nano-microscale organic filler can be prepared from agricultural waste according to this invention provides the sheet material with enhanced strength and physical properties, and also requires fewer steps in organic fibrillated filler preparation since no pretreatment of organic feedstock with chemicals or enzymes before isolating nanocellulose. Moreover, this is a valuable use of resource, reduce waste and agricultural waste including waste from chemical usage in pretreatment compared with the one prepared from other materials such as wood pulp.

According to this invention, the sheet material may be paper, natural polymers, sheet comprising fiber or sheet comprising mostly cellulose fiber where the sheet material according to this invention has the nano-microscale organic fibrillated filler ranging from 0.5 wt % to 25 wt %.

According to this invention, the sheet material has the starch granule ranging from 0.2 wt % to 20 wt %, preferably from 1 wt % to 5 wt %, and microfibrillated cellulose ranging from 0.05 wt % to 15 wt %, preferably from 0.5 wt % to 5 wt %.

According to this invention, the sheet material also comprises fibers derived from materials selected from chemical pulp, mechanical pulp, semi-chemical pulp, recycled pulp, unbleached pulp, bleached pulp or a combination of at least two thereof.

As details described above the sheet material comprising fiber and nano-microscale organic fibrillated filler according to this invention comprising components, amount of components, and those details providing good results as mentioned above. However, the sheet material according to this invention is not limited to the components, amount of components, and details as described above. Nevertheless, an occurrence of any change or alteration is considered to be within the intention and scope of this invention.

Method of Producing Sheet Material

The method of producing the sheet material comprising fiber and nano-microscale organic filler according to this invention comprises the steps of (i) preparing pulp suspension, (ii) preparing nano-microscale organic fibrillated filler, (iii) adding the nano-microscale organic filler into pulp suspension, (iv) forming sheet material by pressing, and (v) drying the sheet material.

According to this invention, the preparation step of nano-microscale organic fibrillated filler provides the nano-microscale organic fibrillated filler comprising microfibrillated cellulose and starch granule in such a way that the microfibrillated cellulose is dispersed with starch granule.

According to this invention, the preparation step of the nano-microscale organic fibrillated filler comprises applying shear force at high pressure to organic feedstock using high-pressure homogenization where the pressure is in a range from 100 bars to 10,000 bars, preferably from 200 bars to 2,000 bars According to this invention, the preparation step of the nano-microscale organic fibrillated filler is performed by using organic feedstock which may be an agricultural waste having cellulose fiber and starch granule as components, preferably the agricultural waste has cellulose fiber and starch sac having starch granule inside of it.

According to this invention, the preparation step of the nano-microscale organic fibrillated filler is performed by using organic feedstock which is an agricultural waste having starch sac having starch granule inside by having starch granule at least 15 wt %, preferably from 40 wt % to 90 wt % of the organic feedstock, which is an agricultural waste.

According to this invention, the preparation step of the nano-microscale organic fibrillated filler is performed by using organic feedstock which is an agricultural waste selected from cassava, potato, sweet potato, sago, taro, yam or a combination of at least two thereof.

According to this invention, the preparation step of the nano-microscale organic fibrillated filler as mentioned above provides the nano-microscale organic, fibrillated filler having starch granule ranging from 15 wt % to 95 wt %, preferably from 40 wt % to 90 wt %.

According to this invention, the preparation step of the nano-microscale Organic fibrillated filler as mentioned above provides the nano-microscale organic fibrillated filler having microfibrillated cellulose ranging from 5 wt % to 85 wt %, preferably from 10 wt % to 60 w %.

According to this invention, the preparation step of the nano-microscale organic fibrillated filler as mentioned above provides the nano-microscale organic fibrillated filler comprising the microfibrillated cellulose with an average diameter ranging from 5 nm to 100 μm, preferably 50 nm to 10 μm, and an average length ranging from 0.02 mm to 0.5 mm.

According to this invention, the preparation step of the nano-microscale organic fibrillated filler as mentioned above provides the nano-microscale organic fibrillated filler comprising the starch granule with average particle size ranging from 5 μm to 60 μm.

As the steps listed above, the preparation step of the nano-microscale organic fibrillated filler by liberating microfibrillated cellulose using shear force at high pressure to the organic feedstock as described above results in cellulose fiber and starch sac, having starch granule inside, disintegrating into microfibrillated cellulose dispersed with starch granule particles without cracking, crushing, melting or transforming starch granule particles. As applying the prepared nano-microscale organic fibrillated filler in sheet material production, this provides not only sheet material with enhanced strength and physical properties, but also less drainage time during sheet material formation compared to the one using typical nano-microscale organic cellulose fiber, e.g. wood pulps.

In addition, the use of organic feedstock being agricultural waste as indicated above consumes less shear energy, and no need to prepare the feedstock in advance by pretreatment with chemicals or enzymes in comparison to the one using other feedstock such as wood pulp.

According to this invention, the preparation step of pulp suspension can be carried out using pulp selected from chemical pulp, mechanical pulp, semi-chemical pulp, recycled pulp, unbleached pulp, bleached pulp or a combination of at least two thereof.

According to this invention, the sheet material prepared by the method described above is paper, natural polymers, sheet comprising fiber or sheet comprising mostly cellulose fiber.

As details described above, the method of producing sheet material comprising fiber and nano-microscale organic fibrillated filler according to this invention comprising the step, equipment, and description provides good results as mentioned above. However, the sheet material according to this invention is not limited to the step, equipment, and description as described above. Nevertheless, an occurrence of any change or alteration is considered to be within the intention and scope of this invention.

The invention will be further exemplarily explained as follow, however; it should be understood that these examples are not limited the scope of this invention.

EXAMPLE

1. Preparation of Nano-Microscale Organic Filler

In nano-microscale organic fibrillated filler preparation, sample of organic feedstock selected from agricultural waste such as cassava, potato, sweet potato, taro or yam was dispersed in water With concentration consistency ranging from about 3 wt % to 10 wt % prior to feeding into a high-pressure homogenizer with various cycle at pressure 400 bars to 1,000 bars providing shear force on the cellulose fiber and the starch sac having starch granule inside in the organic feedstock. The derived nano-microscale organic filler has distribution of components i.e. microfibrillated cellulose and starch granule different from the organic feedstock used as shown in FIG. 1.

Figure 2:
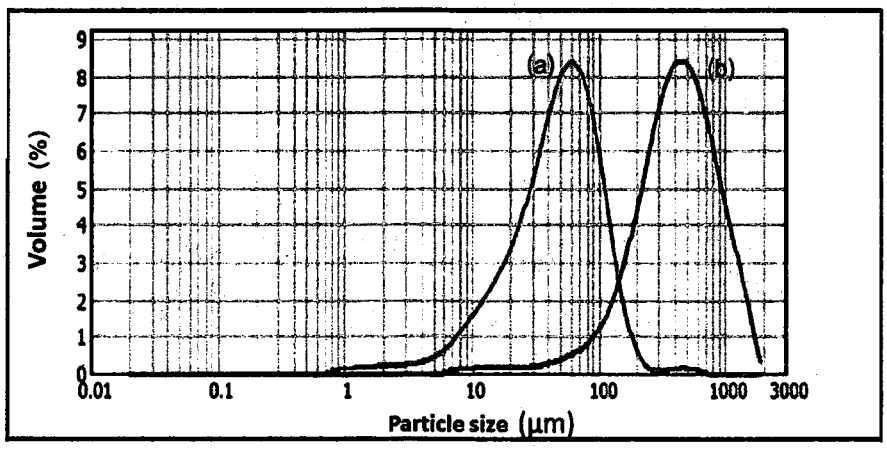
FIG. 2 is a graph showing particle size distribution of nano-microscale organic fibrillated filler according to this invention (a), and typical organic filler, i.e. the organic feedstock is not passed through a filler preparation step according to this invention (b).
Figure 3:
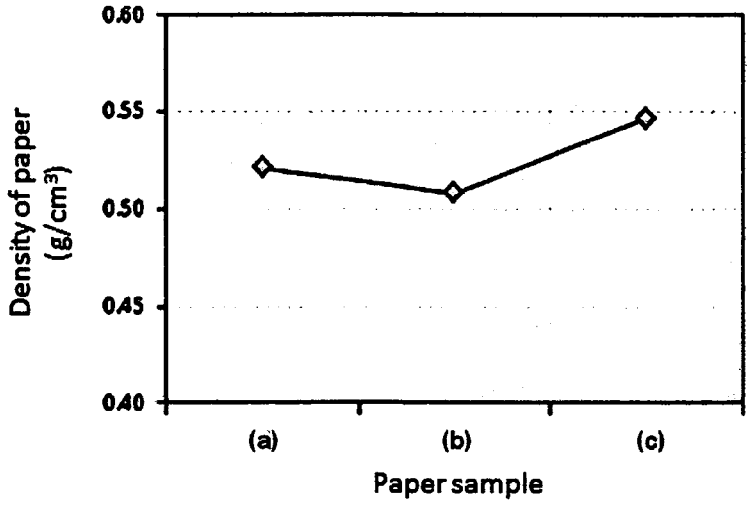
FIG. 3 is a graph showing density of paper sample without any filler (a), paper sample with typical organic filler, i.e. the organic feedstock is not passed through a filler preparation step according to this invention (b), and paper sample with nano-microscale organic fibrillated filler according to this invention (c).
Figure 4:
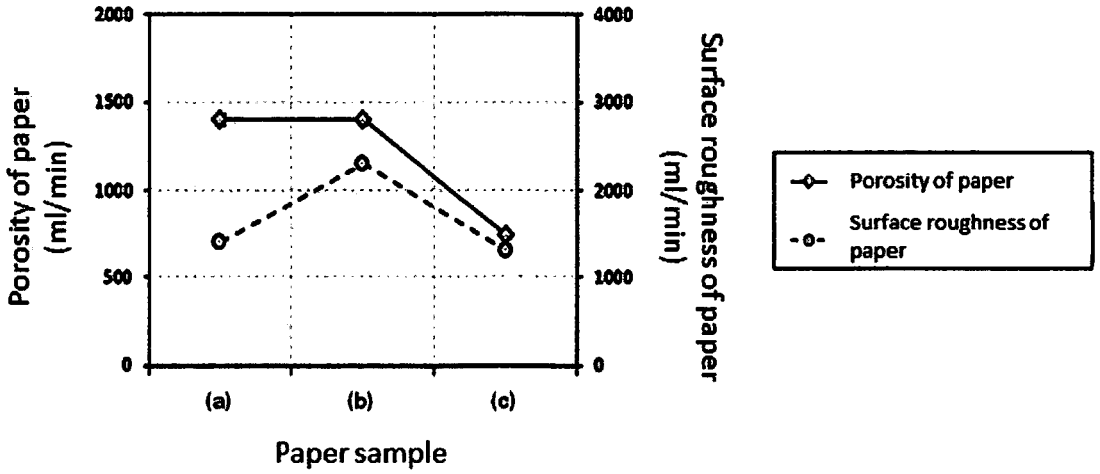
FIG. 4 is a graph showing the results of porosity and surface roughness of paper sample without any fillers (a), paper sample with typical organic filler, i.e. the organic feedstock is not passed through a filler preparation step according to this invention (b), and paper sample with nano-microscale organic fibrillated filler according to this invention (c).
Figure 5:
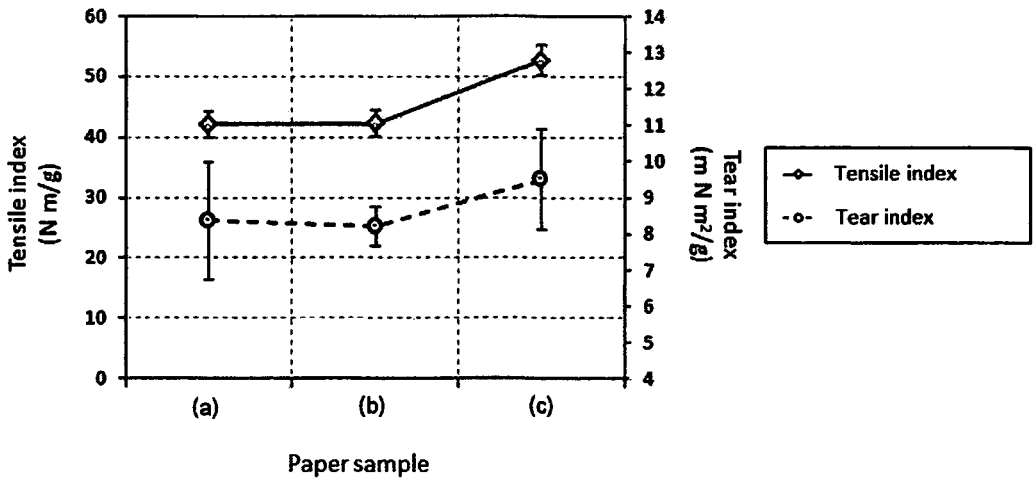
FIG. 5 is a graph showing the results of tensile index and tear index of paper sample without any fillers (a), paper sample with typical organic filler, i.e. the organic feedstock is not passed through a filler preparation step according to this invention (b), and paper sample with nano-microscale organic filler according to this invention (c).

From analysis using optical microscope, it reveals that the organic feedstock comprises fiber, starch sac having starch granule inside of it, bulk of starch granule having average particle about 500 μm, while the prepared nano-microscale organic fibrillated filler according to the method of this invention comprises microfibrillated cellulose dispersed with starch granule. Since the starch sac having starch granule inside was disintegrated by shear force while remaining starch granule condition allowing a size reduction of the nano-microscale organic fibrillated filler nearly 10 times as shown in FIG. 2 and Table 1.

TABLE 1 particle size of the nano-microscale filler and organic feedstock.

| | Distribution of particle size (μm) | | | |
|---|---|---|---|---|
| Sample | d(0.1)* | d(0.5)* | d(0.9)* | average particle size d[4, 3]** |
| Organic feedstock | 147.5 | 425.3 | 1019.3 | 513.4 |
| Nano-microscale organic filler | 13.4 | 49.6 | 113.7 | 59.6 |

*d (0.1), d(0.5) and d(0.9) are identification for particle size of population, accounting for 10, 50 and 90% by volume, observing particles smaller or equal to the analyzed size, respectively.
**d[4, 3] is an average diameter of the particles by volume.

2. Preparation of Sheet Material with Nano-Microscale Organic Fibrillated Filler In sheet material preparation, the organic feedstock and the prepared nano-microscale organic fibrillated filler were used as additive in the wet-end papermaking process by mixing filler both types in various amounts (in this case 30, 50 and 100 kg per tonne of paper) with pulp suspension before forming paper and drying by rotary dryer at temperature of 150° C.

In this papermaking, it was performed using pulp suspension prepared from three different types of pulp, i.e. unbleached pulp, mixed paper-box recycled pulp, corrugated box recycled pulp, by controlling paper grammage to 150 g/m$^2$.

Sample of sheet material prepared by the method according to the invention was performed physical properties testing, which are

- Tensile index according to standard testing ISO 924-2: 2008,
- Stretch of sheet material according to standard testing ISO 1924-2: 2008,
- Burst index according to standard testing ISO 2758, 2759: 2001,
- Tensile energy absorption (TEA) according to standard testing ISO 1924-2: 2008,
- Ring crush testing according to standard testing ISO 12192: 2002,
- Corrugating medium testing (CMT) according to standard testing Tappi: T824 om-02,
- Tear index according to standard testing ISO 1974: 2012,
- Tensile stiffness index according to standard testing ISO 1924-2: 2008,
- Short span compression testing (SCT) index according to standard testing ISO 9895: 1989,
- Ply bond according to standard testing Tappi 569 pm-09,
- Porosity according to standard testing ISO 5636-3: 1992,
- Folding endurance according to standard testing ISO 526: 1993,
- Freeness according to standard testing Tappi T221,
- Drainage time during forming sheet material according to standard testing Tappi T221

3. Effect of Nano-Microscale Organic Fibrillated Filler on Physical Properties of the Sheet Material Investigating effect of filler on the physical properties of the sheet material, the physical properties testing was performed for paper sample prepared from unbleached pulp including a paper without fillers (a), a paper sample with the typical organic filler, i.e. the organic feedstock is not passed through a filler preparation step according to this invention (b), and a paper sample with nano-microscale organic filler according to this invention (c). Test results are shown in FIG. 3-9.

Considering the density, porosity, and surface roughness' of the paper (FIG. 3 and FIG. 4) shows that the paper with nano-microscale organic fibrillated filler (c) has the highest density. This is consistent with the porosity of paper exhibiting lowest value, whereas the paper with the typical organic filler (b) has maximum surface roughness.

From tensile index and tear index results of paper (FIG. 5), it appears that the paper with nano-microscale organic fibrillated filler (c) showing an increase in tensile index by 25% and an increase in tear index by 14% comparable to the paper without filler. Besides, the organic fillers (b) does not affect tensile index and tear index of the paper significantly comparable to the paper without filler (a).

Figure 6:
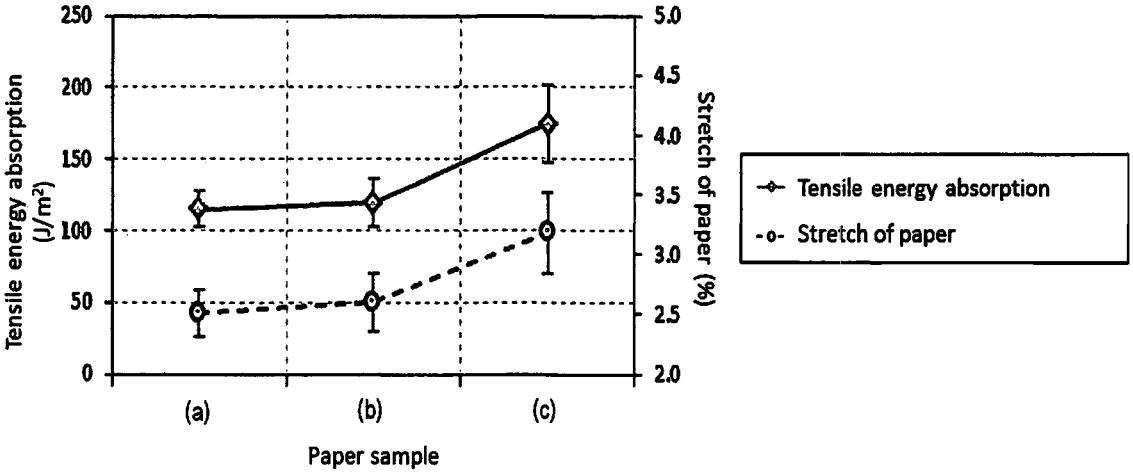
FIG. 6 is a graph showing the results of tensile energy absorption (TEA) and stretch of paper sample without any filler (a), paper sample with typical organic filler, i.e. the organic feedstock is not passed through a filler preparation step according to this invention (b), and paper sample with nano-microscale organic filler according to this invention (c).
Figure 7:
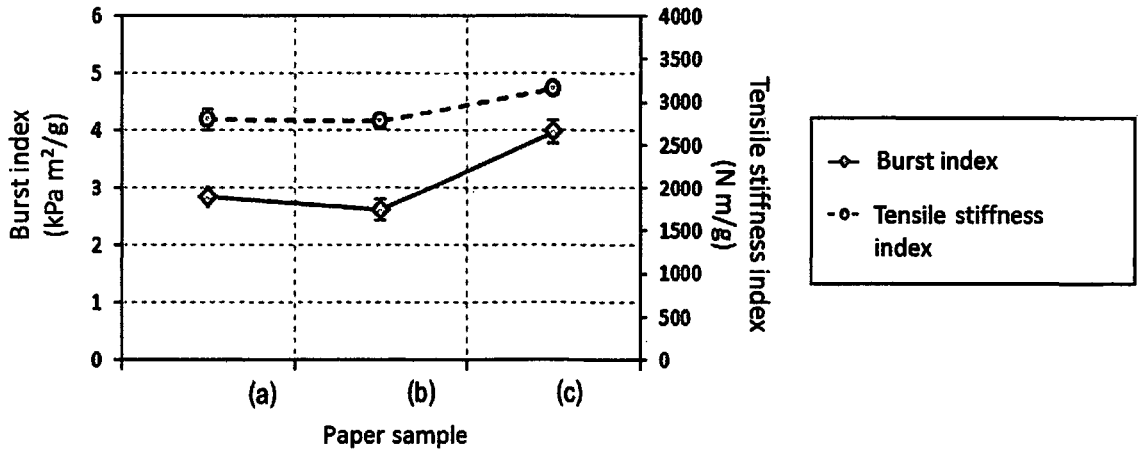
FIG. 7 is a graph showing the results of burst index and tensile stiffness index of paper sample without any filler (a), paper sample with typical organic filler, i.e. the organic feedstock is not passed through a filler preparation step according to this invention (b), and paper sample with nano-microscale organic filler according to this invention (c).

FIG. 6 shows tensile energy absorption (TEA) and stretch of the paper with nano-microscale organic fibrillated filler (c) increases 52% and 27%, respectively, whereas the paper with the typical organic filler (b) has the value increased by only 3-4%, compared with the paper without fillers (a).

From burst index and tensile stiffness index results of the paper (FIG. 7), it appears that the paper with nano-microscale organic fibrillated filler (c) showing an increase in burst index by 13% and an increase in tensile stiffness index by 40%, Whereas the paper with the typical organic filler (b) exhibits declined burst index and tensile stiffness index by 0-8% compared with the paper without filler (a).

Figure 8:
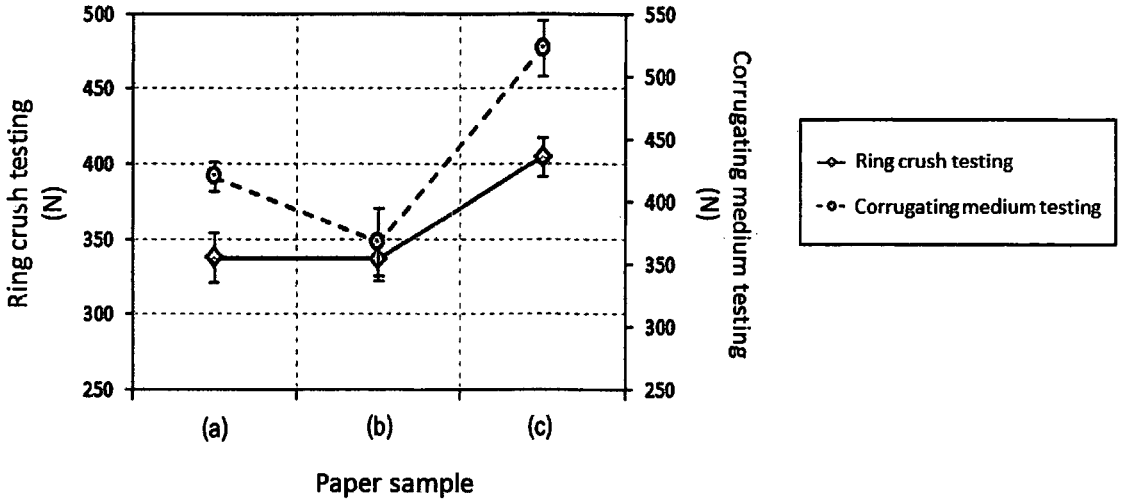
FIG. 8 is a graph showing the results of ring crush testing and corrugating medium testing of paper sample without any filler (a), paper sample with typical organic filler, i.e. the organic feedstock is not passed through a filler preparation step according to this invention (b), and paper sample with nano-microscale organic filler according to this invention (c).
Figure 9:
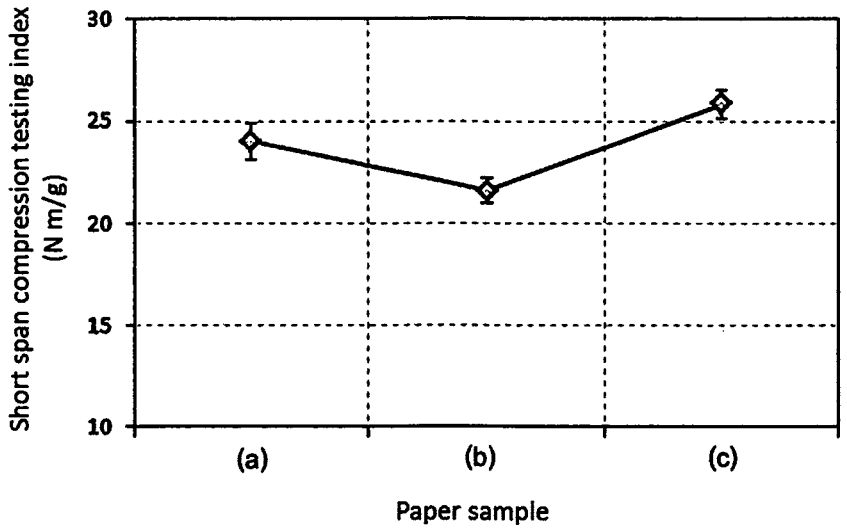
FIG. 9 is a graph showing the results of short span compression testing of paper sample without any filler (a), paper sample with typical organic filler, i.e. the organic feedstock is not passed through a filler preparation step according to this invention (b); and paper sample with nano-microscale organic filler according to this invention (c).
Figure 10A:
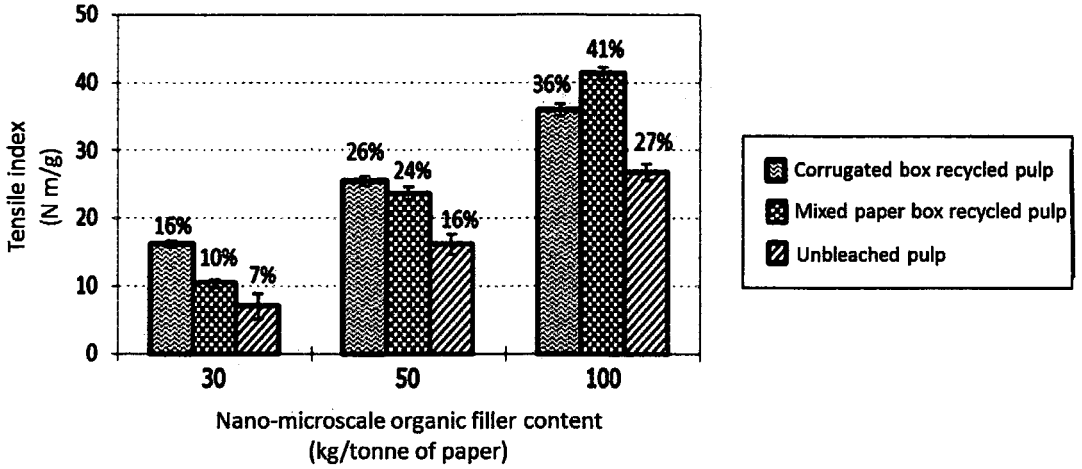
FIG. 10A-10L is a graph showing the results of various physical properties of paper sample prepared from unbleached wood pulp, mixed paper-box recycled pulp, and corrugated box recycled pulp with various amount of nano-microscale organic fibrillated filler according to this invention, i.e. 30, 50 and 100 kg/tonne of paper.
Figure 10B:
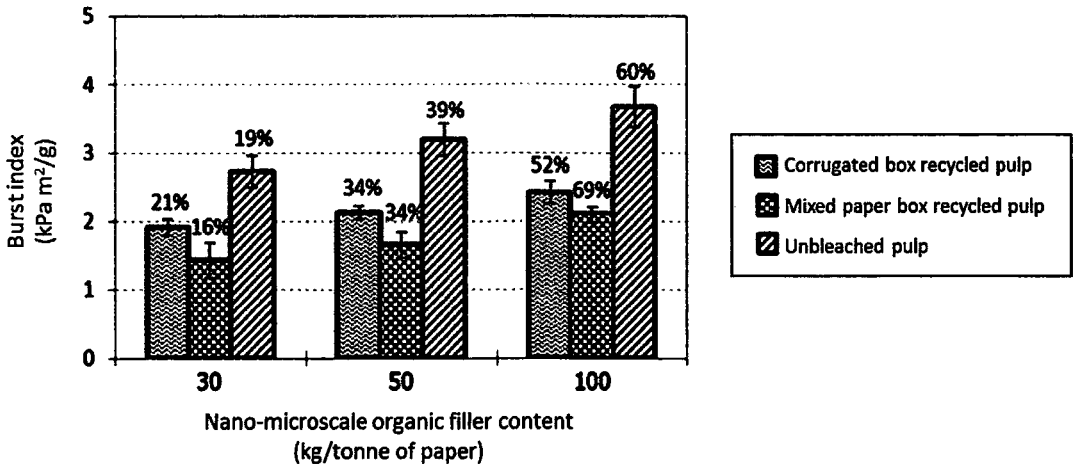
Figure 10C:
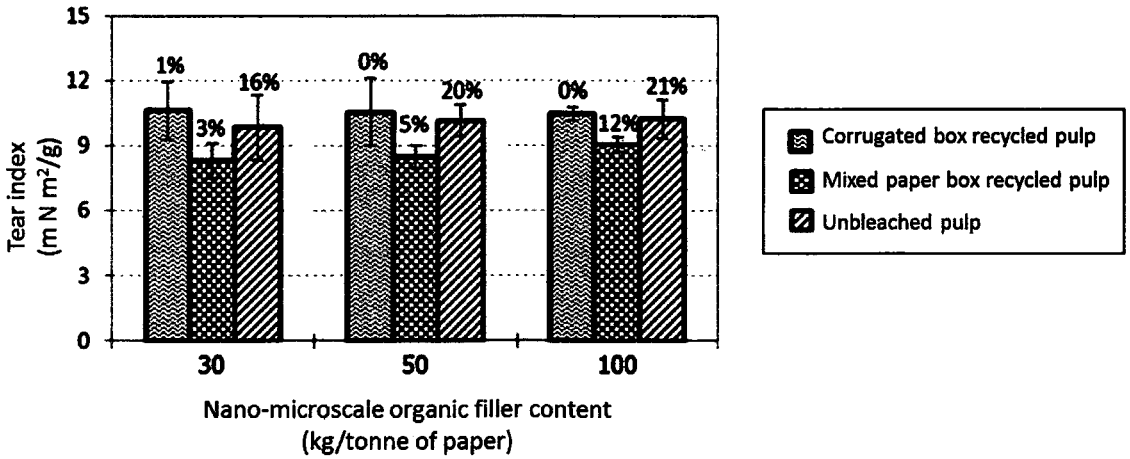
Figure 10D:
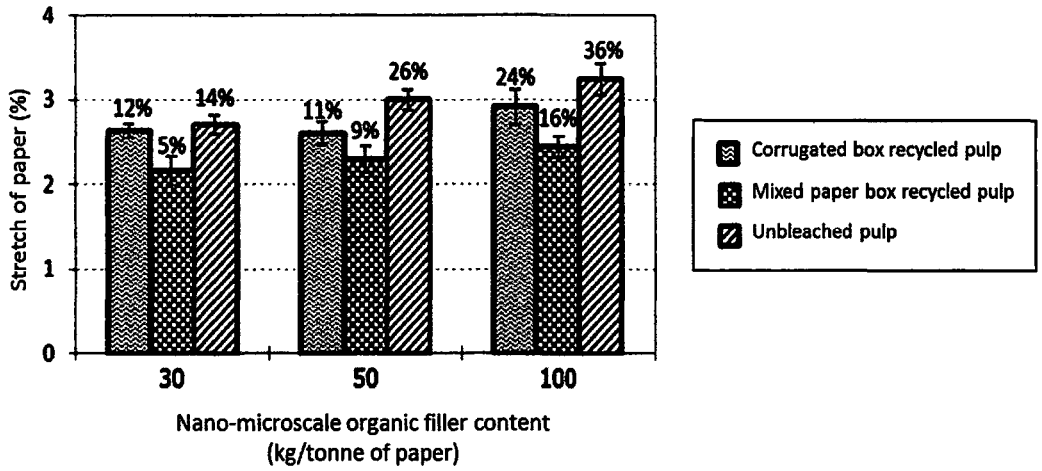
Figure 10E:
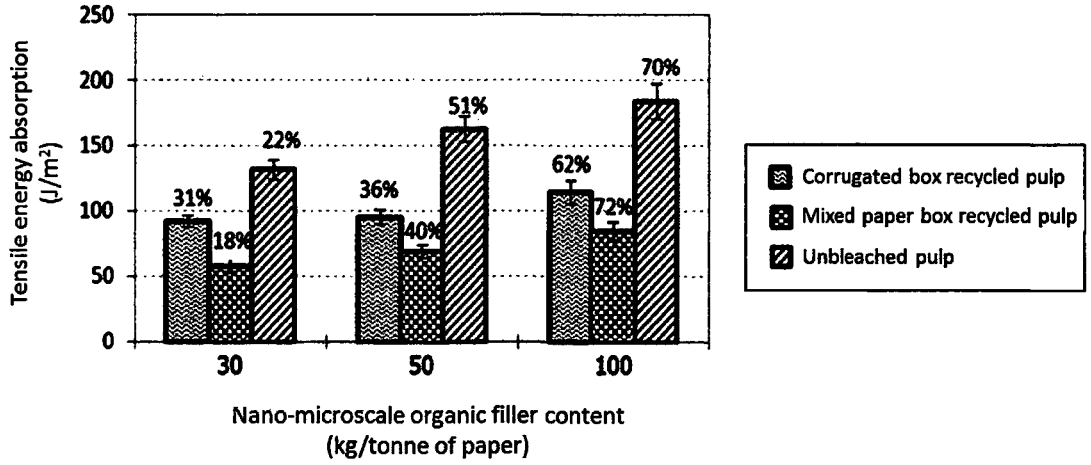
Figure 10F:
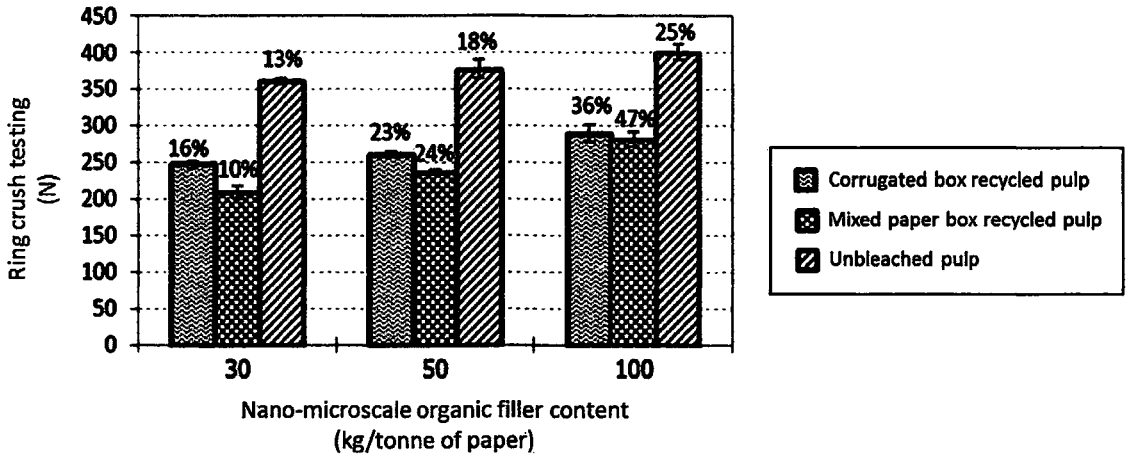
Figure 10G:
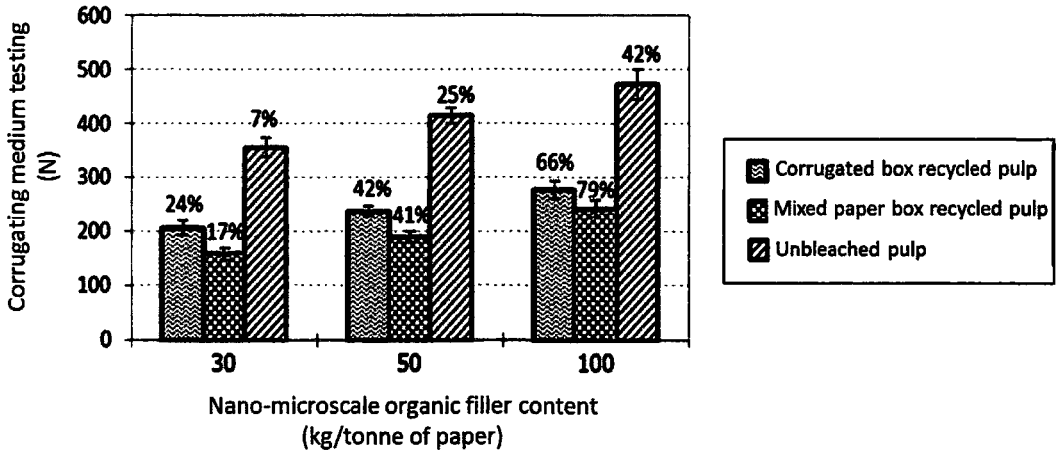
Figure 10H:
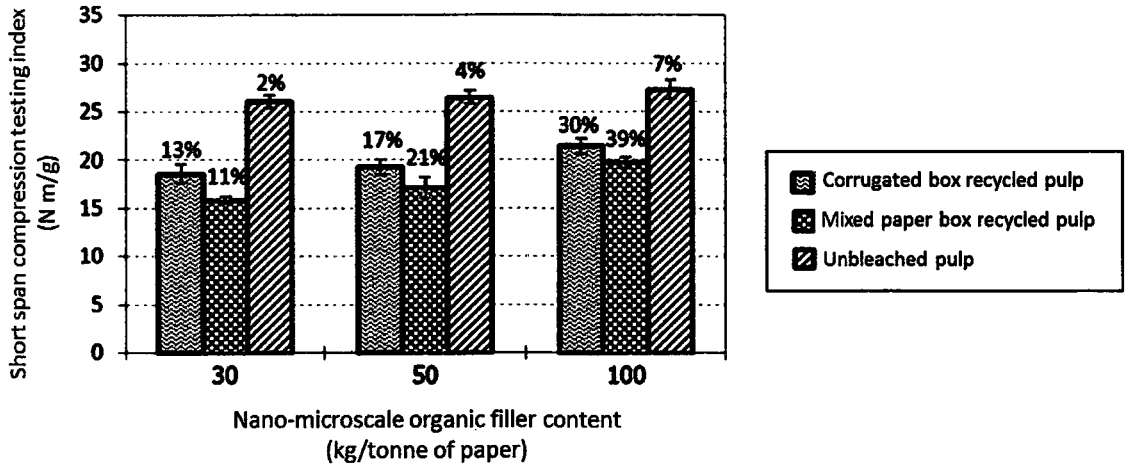
Figure 10I:
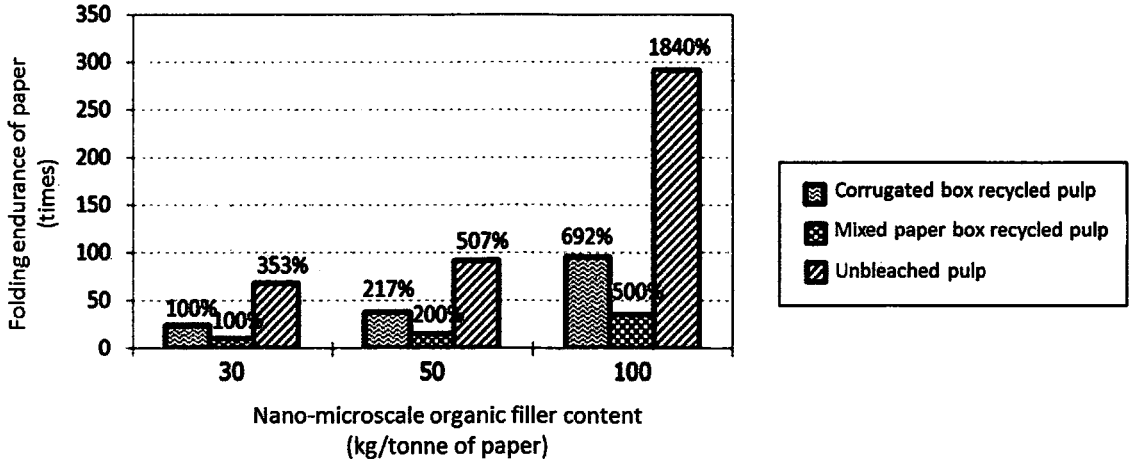
Figure 10J:
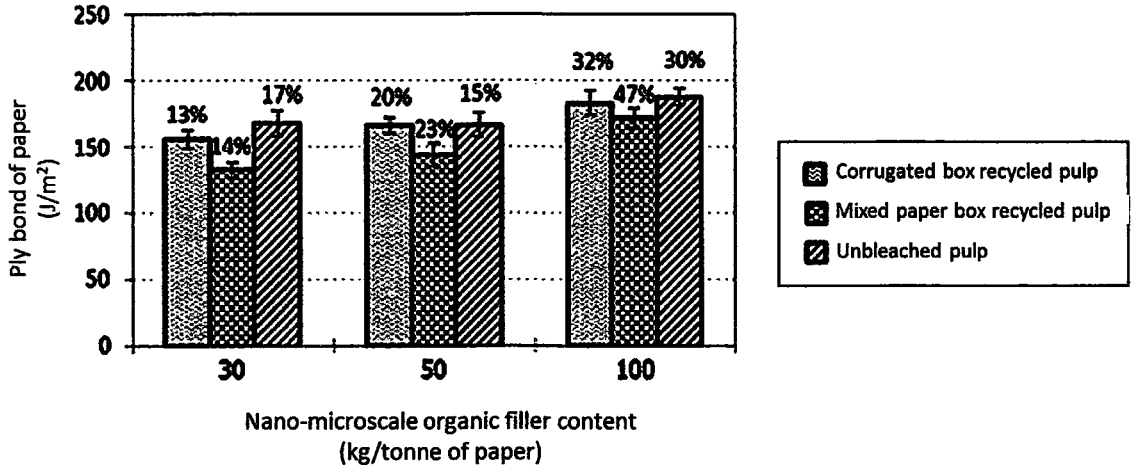
Figure 10K:
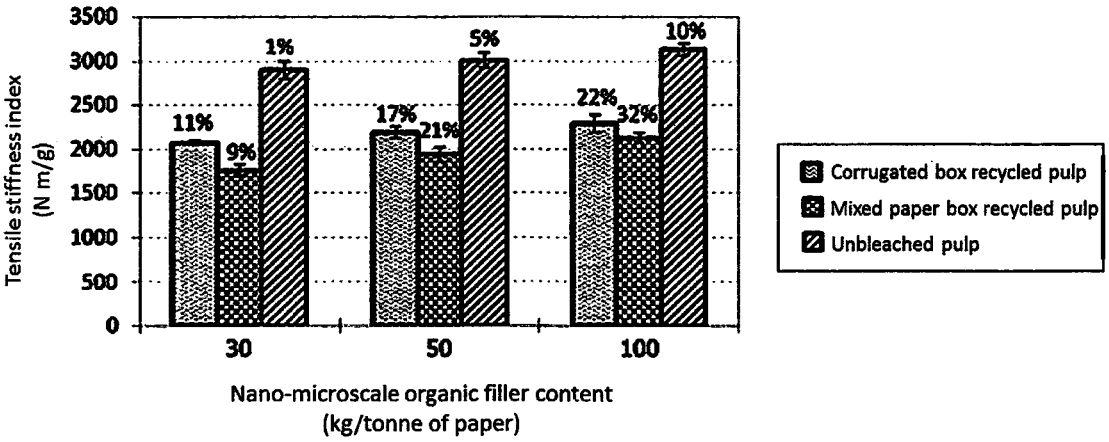
Figure 10L:
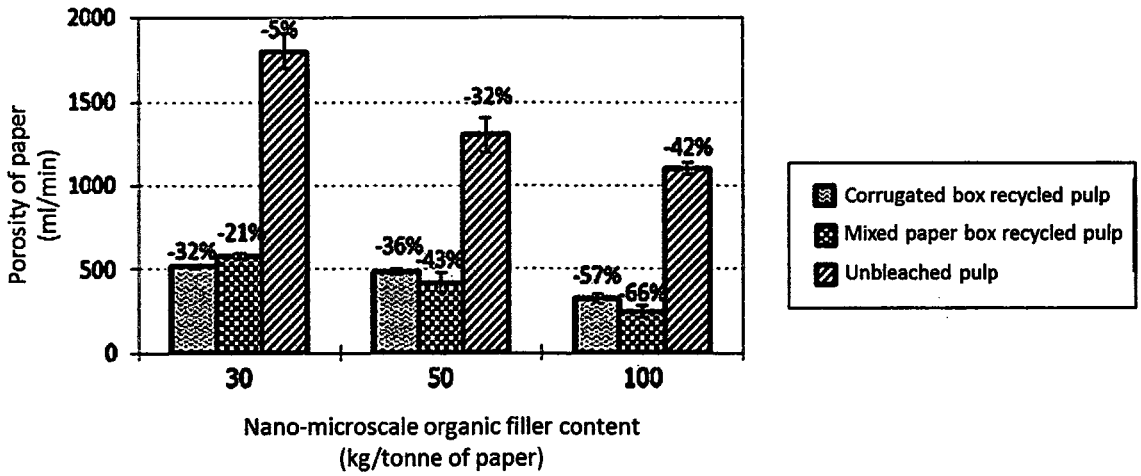

FIG. 8 shows that the ring crush testing and corrugating medium testing of the paper with nano-microscale organic fibrillated filler (c) increased 25% and 20%, respectively, whereas the paper with the typical organic filler (b) exhibits declined ring crush testing and corrugating medium testing by 0-12% compared with the paper without fillers (a).

From the short span compression testing (SCT) index (FIG. 9), it appears that the paper with nano-microscale organic fibrillated filler (c) has a greater short span compression testing index by 5%, whereas the paper with the typical organic filler (b) exhibits a declined short span compression testing index by 10% compared with the paper without filler (a).

4. Effect of Nano-Microscale Organic Fibrillated Filler Amount and Pulp Type on Physical Properties of Sheet Material Paper sample prepared from unbleached wood pulp, corrugated box recycled pulp, and mixed paper-box recycled pulp having various amount of nano-microscale organic fibrillated fillers, i.e. 30, 50, and 100 kg per tonne of paper was performed physical properties testing compared to the paper without filler.

From test results, it's found that the greater nano-microscale organic fibrillated filler in the paper (from 30 to 50 and 100 kg per tonne of paper, respectively) results in better physical properties where improving proportion of the physical properties of the paper are based on the pulp type used in papermaking as well (FIG. 10A-10L).

For example, when compare the physical properties of the paper sample—prepared from three types of pulp, i.e. unbleached wood pulp, corrugated box recycled pulp, and mixed paper-box recycled pulp at 50 kg/tonne paper of nano-microscale organic fibrillated filler. It appears that:

- tensile index of the paper increased 16%, 24% and 26%, respectively,
- burst index increased 39%, 34% and 34%, respectively,
- tear index increased 20%, 5% and 0%, respectively,
- stretch of the paper increased 26%, 9% and 11%, respectively,
- tensile energy absorption increased 51%, 40% and 36%, respectively,
- ring crush testing increased 18%, 24% and 23%, respectively,
- corrugating medium testing increased 25%, 41% and 42%, respectively,
- short span compression testing index increased 4%, 21% and 17%, respectively,
- folding endurance of the paper increased 507%, 200% and 217%, respectively,
- ply bond of the paper increased 15%, 23% and 20%, respectively,
- tensile stiffness index increased 5%, 21% and 17%, respectively,
- porosity decreased 32%, 42% and 36%, respectively.

It is also found that the physical properties of the paper sample with nano-microscale organic fibrillated filler prepared by the method in this invention appear to be better than the one with typical organic filler.

5. Comparison of Nano-Microscale Organic Fibrillated Filler to Organic Filler Being Nano-Micro Cellulose Fiber Derived from Wood Pulp The nano-microscale organic fibrillated filler according to this invention and the organic filler being nano-micro cellulose fiber derived from wood pulp were employed as filler in the wet-end papermaking process to compare technical gains regarding production method.

Figure 11:
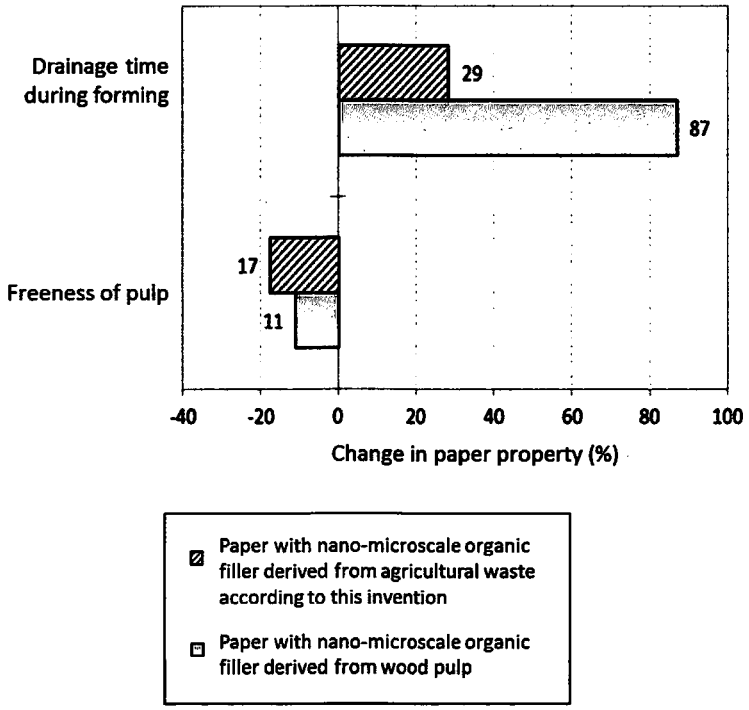
FIG. 11 is a graph showing the results of freeness of paper pulp and drainage time during forming of paper sample with nano-microscale organic fibrillated filler according to this invention and paper sample with nano-microscale organic cellulose fiber from typical wood pulps.

The test results show that applying nano-microscale organic fibrillated filler according to this invention enhances water drainage during the paper formation by consuming less drainage time by almost 3 times comparing to the use of the organic cellulose fiber being nano-micro cellulose fiber derived from wood pulp in paper production from unbleached wood pulp as shown in FIG. 11.

From this test results, it shows that the method of producing sheet material comprising the preparation step of nano-microscale organic fibrillated filler, and use of this filler prepared according to this invention can reduce overall paper production's step and time.

The invention claimed is:

1. A sheet material comprising fiber and nano-microscale organic fibrillated filler comprising microfibrillated cellulose and a starch granule as components, wherein the nano-microscale organic fibrillated filler is produced by applying a shear force at high pressure to an organic feedstock thereby liberating the starch granule from a starch sac of the organic feedstock and obtaining the microfibrillated cellulose from the organic feedstock, wherein the microfibrillated cellulose is dispersed with the starch granule within the nano-microscale organic fibrillated filler, and wherein the nano-microscale organic fibrillated filler comprises the starch granule at least 15 wt %.

2. The sheet material according to claim 1, wherein the nano-microscale organic fibrillated filler comprises the starch granule ranging from 15 wt % to 95 wt %.

3. The sheet material according to claim 1, wherein the nano-microscale organic fibrillated filler comprises microfibrillated cellulose ranging from 5 wt % to 85 wt %.

4. The sheet material according to claim 1, wherein the nano-microscale organic fibrillated filler has an average particle size ranging from 5 nm to 600 μm.

5. The sheet material according to claim 1, wherein the applying shear force at high pressure to the organic feedstock is performed by using pressure ranging from 100 bars to 10,000 bars.

6. The sheet material according to claim 1, wherein the applying shear force at high pressure to the organic feedstock is performed by using high-pressure homogenization.

7. The sheet material according to claim 1, wherein the organic feedstock is an agricultural waste selected from cassava, potato, sweet potato, sago, taro, yam or a combination of at least two thereof.

8. The sheet material according to claim 1, wherein the microfibrillated cellulose has an average diameter ranging from 5 nm to 100 μm and an average length ranging from 0.02 mm to 0.5 mm.

9. The sheet material according to claim 1, wherein the starch granule has an average particle size ranging from 5 μm to 60 μm.

10. The sheet material according to claim 1, wherein the sheet material has the nano-microscale organic fibrillated filler ranging from 0.5 wt % to 25 wt %.

11. The sheet material according to claim 1, wherein the sheet material has the starch granule ranging from 0.2 wt % to 20 wt %.

12. The sheet material according to claim 1, wherein the sheet material has the microfibrillated cellulose ranging from 0.05 wt % to 15 wt %.

13. The sheet material according to claim 1, wherein the fiber is derived from material selected from chemical pulp, mechanical pulp, semi-chemical pulp, recycled pulp, unbleached pulp, bleached pulp or a combination of at least two thereof.

14. The sheet material according to claim 2, wherein the nano-microscale organic fibrillated filler comprises the starch granule ranging from 40 wt % to 90 wt %.

15. The sheet material according to claim 3, wherein the nano-microscale organic fibrillated filler comprises the microfibrillated cellulose ranging from 10 wt % to 60 wt %.

16. The sheet material according to claim 4, wherein the nano-microscale organic fibrillated filler has an average particle size ranging from 50 nm to 200 μm.

17. The sheet material according to claim 1, wherein the applying shear force at high pressure to the organic feedstock is performed by using high-pressure homogenization.

18. The sheet material according to claim 8, wherein the microfibrillated cellulose has an average diameter ranging from 50 nm to 10 μm.

19. The sheet material according to claim 12, wherein the sheet material has the microfibrillated cellulose ranging from 0.5 wt % to 5 wt %.

20. A method of producing a sheet material comprising fiber and nano-microscale organic fibrillated filler comprising microfibrillated cellulose and a starch granule as components, wherein the method comprising the steps of:

(i) preparing pulp suspension, (ii) preparing nano-microscale organic fibrillated filler by applying a shear force at high pressure to an organic feedstock thereby liberating the starch granule from a starch sac of the organic feedstock and obtaining the microfibrillated cellulose from the organic feedstock such that the nano-microscale organic fibrillated filler comprises the starch granule at least by 15 wt %, (iii) adding the nano-microscale organic fibrillated filler into pulp suspension, (iv) forming sheet material by pressing, and (v) drying the sheet material.

21. The method of producing a sheet material according to claim 20, wherein the nano-microscale organic fibrillated filler comprises the starch granule ranging from 15 wt % to 95 wt %.

22. The method of producing a sheet material according to claim 20, wherein the nano-microscale organic fibrillated filler comprises microfibrillated cellulose ranging from 5 wt % to 85 wt %.

23. The method of producing a sheet material according to claim 20 or 21, wherein the starch granule has an average particle size ranging from 5 μm to 60 μm.

24. The method of producing a sheet material according to claim 20 or 22, wherein the microfibrillated cellulose has an average diameter ranging from 5 nm to 100 μm and an average length ranging from 0.02 mm to 0.5 mm.

25. The method of producing a sheet material according to claim 20, wherein the applying shear force at high pressure to the organic feedstock uses pressure ranging from 100 bars to 10,000 bars.

26. The method of producing a sheet material according to claim 20, wherein the applying shear force at high pressure to organic feedstock is performed by using high-pressure homogenization.

27. The method of producing a sheet material according to claim 20, wherein the organic feedstock is an agricultural waste selected from cassava, potato, sweet potato, sago, taro, yam, or a combination of at least two thereof.

28. The method of producing a sheet material according to claim 27, wherein the agricultural waste has cellulose fiber and starch sac having the starch granule inside of it as components.

29. The method of producing a sheet material according to claim 27 or 28, wherein the agricultural waste with starch sac comprises the starch granule at least 15 wt %.

30. The method of producing a sheet material according to claim 20, wherein the pulp suspension is prepared from chemical pulp, mechanical pulp, semi-chemical pulp, recycled pulp, unbleached pulp, bleached pulp, or a combination of at least two thereof.

31. The method of producing a sheet material according to claim 20, wherein the sheet material is paper, natural polymers, sheet comprising fiber or sheet comprising mostly cellulose fiber.

* * * * *